US005707769A

United States Patent [19]

Hagi et al.

[11] Patent Number: 5,707,769

[45] Date of Patent: Jan. 13, 1998

[54] YELLOW TONER AND MAGENTA TONER AND IMAGE FORMING APPARATUS AND METHOD USING SAME

[75] Inventors: Masayuki Hagi, Takatsuki; Katsunori Kurose; Takeshi Arai, both of Amagasaki; Junichi Tamaoki, Sakai; Hiroyuki Fukuda, Kobe; Yoko Osawa, Shiga; Miyoko Goto, Itami, all of Japan

[73] Assignee: Minolta Co., Ltd., Osaka, Japan

[21] Appl. No.: 503,801

[22] Filed: Jul. 18, 1995

[30] Foreign Application Priority Data

| | | | |
|---|---|---|---|
| Jul. 21, 1994 | [JP] | Japan | 6-169478 |
| Aug. 29, 1994 | [JP] | Japan | 6-203477 |
| May 17, 1995 | [JP] | Japan | 7-118273 |

[51] Int. Cl.[6] ..... G03G 9/09

[52] U.S. Cl. ..... 430/106; 430/109

[58] Field of Search ..... 430/106, 109, 430/110

[56] References Cited

U.S. PATENT DOCUMENTS

| | | | |
|---|---|---|---|
| 4,590,139 | 5/1986 | Imai et al. | 430/45 |
| 4,777,105 | 10/1988 | Macholdt et al. | 430/109 |
| 4,954,410 | 9/1990 | Takuma et al. | 430/109 |
| 5,250,996 | 10/1993 | Suguzaki et al. | 430/109 |
| 5,500,318 | 3/1996 | Tanikawa et al. | 430/109 |

*Primary Examiner*—John Goodrow

*Attorney, Agent, or Firm*—Burns, Doane, Swecker & Mathis, LLP

[57] ABSTRACT

A negatively chargeable color toner for full-color image forming, comprising a specific linear polyester resin and C. I. Solvent Yellow 162 or a specific anthraquinone magenta dye or an anthraquinone magenta dye together with a quinacridone magenta pigment.

31 Claims, 3 Drawing Sheets

YELLOW TONER AND MAGENTA TONER AND IMAGE FORMING APPARATUS AND METHOD USING SAME

BACKGROUND OF THE INVENTION

1. Field of the Invention

The present invention relates to color toners for use in image forming apparatus such as electrostatic copying machines, laser printers and the like, and image forming apparatus and image forming method for using the color toners. More specifically the present invention relates to negative charging yellow toner and magenta toner with excellent transmittancy, which are usable in image forming methods including heating roller fixing process, and image forming method and image forming apparatus using the toners.

2. Description of the Related Art

Conventional electrophotographic image forming methods are widely used in copying machines, printers, facsimiles and the like, and in recent years have become commonly used with full-color methods for reproducing multicolor images by overlaying a plurality of color toners.

In electrophotographic full-color image forming methods, image formation is accomplished by, for example, a process such as that described below.

First, the surface of a photosensitive member uniformly charged with a negative potential is optically exposed by a digital method using a shutter array or the like so as to form an electrostatic latent image in dot units. Typically, a negative charging organic photosensitive member is used due to cost and electrostatic properties. Thus, an electrostatic latent image formed on the surface of an organic photosensitive member is subjected to reversal development by a negative charging toner selected from the group of magenta toner, cyan toner, and yellow toner, and black toner as necessary, and the obtained toner image of specific color is transferred onto an intermediate transfer member. Multicolor images are formed by sequentially overlaying toner images on an intermediate transfer member by sequentially performing the same developing and transferring processes as described above for the other toners, transferring the obtained full-color toner image onto a recording sheet and fixing the toner image thereon.

An alternative method provides that toner images of each color obtained in the same manner as described above are successively transferred onto a recording sheet maintained on a transfer member such as a transfer drum and transfer belt, so as to form a full-color toner image which is subsequently fixed on the recording sheet.

The full-color image forming methods described above are mainly used to reproduce pictures, photographs, graphic images and the like. As previously mentioned, multicolor images reproduced by overlaying a plurality of toners of various colors are not limited simply to image formation on a recording sheet, and are widely used on overhead projector transparencies (OHP sheets). Therefore, following properties are demand for the toner:

(a) having a spectral reflectancy corresponding to a desired color;

(b) having an excellent transmittancy without hiding the colors of the bottom layer toners of the overlay.

And then, since the obtained multicolor images are often stored on a resin-formed transparent file (polyvinyl chloride sheet), following propertie is also required:

(c) not plasticized by a plasticizer contained in a transparent file so as to prevent to adhere to the transparent file and soil the developed image (i.e., having an excellent resistance to polyvinyl chloride).

In the full-color image forming method described above, the multicolor toner image ultimately obtained is fused onto a recording medium such as plain paper sheet by a fixing process. Fixing methods include heating roller fixing methods for fixing a toner image using heat and pressure by passing a recording medium bearing a toner image between a pair of rollers among which at least one roller has an internal heater built in, the heating roller fixing methods being advantageous inasmuch as it provides excellent thermal efficiency and is suitable for high-speed fixing.

Although heating roller fixing methods provide various advantages, they also present certain disadvantage including so-called offset phenomenon. The offset phenomenon means soiling of a recording sheet which occures when a part of the toner forming the image migrates to the surface of the heating roller during fixing process and is transferred to a subsequent recording sheet transported thereto. Furthermore, the constituents of the toner such as coloring agents may cause soiling of the interior of the image forming apparatus due to sublimation during thermal fusion by the heating roller.

Various methods have been proposed to prevent the offset phenomenon. One such method is to provide offset preventing characteristics in the toner itself by using a resins having broad molecular weight distributions as the toner binding resin and incorporating offset preventing agents such as wax and the like in the toner. Another such method is to coat the surface of the heating roller with a releasing oil such as silicon oil during the fixing process.

When the toner itself is provided with offset preventing characteristics in a toner used in full-color image forming methods, such characteristics are a primary cause of toner transmittancy reduction. On the other hand, the constituents of the toner used in oil-coated heating roller fixing methods must be insoluble in the oil.

The well known organic pigments and dyes used as coloring agents used in conventional yellow toners and magenta toners have various disadvantages. For example, while organic pigments generally have excellent heat resistance and light resistance compared to dyes, transmittancy is reduced by the intensified opacifying power due to the presence of the particles dispersed within the toner. Light scattering by the particles dispersed in the toner prevents the spectral reflectance necessary to accurately reproduce a document, and darkens the projection image and reduces hue when using OHP transparencies due to insufficient transmittancy resulting from the intensified opacifying power. Dyes generally have excellent transmittancy and color hue, but are disadvantageous insofar as they reduce a heat resistance and a light resistance due to their presence in a dissolved state within the toner binding resin. Even if excellent images having excellent hue are obtained such excellence cannot be maintained over a long term due to discoloration caused by exposure to light which results from reduced light resistance. Furthermore, due to their low heat resistance the dyes are sublimated in the vicinity of the fixing region when using heating roller fixing methods, thereby readily soiling the interior of the image forming apparatus, and the dyes dissolve in the releasing oil and ultimately fuse onto the heating roller, thereby causing the previously mentioned offset phenomenon.

SUMMARY OF THE INVENTION

An object of the present invention is to provide excellent yellow toner and magenta toner.

Another object of the present invention is to provide a yellow toner and a magenta toner having excellent color qualities, transmittancy, and polyvinyl chloride resistance.

Another object of the present invention is to provide negative charging yellow toner and magenta toner which do not soil the interior of the image forming apparatus when fixed using a heating roller fixing device, and which specifically do not contaminate the releasing oil coating the heating roller.

Another object of the present invention is to provide a magenta toner for full-color image having excellent secondary color reproducibility when overlaid on yellow toner or cyan toner.

A further object of the present invention is to provide an image forming method capable of producing excellent color images.

A further object of the present invention is to provide an image forming method having excellent color characteristics, transmittancy, and polyvinyl chloride resistance, and which is capable of forming images without soiling the interior of the image forming apparatus, and particularly not contaminating the releasing oil coating the heating roller with coloring agent, even when said images are fixed using a heating roller fixing device.

A still further object of the present invention is to provide an image forming apparatus capable of forming excellent color images.

An even further object of the present invention is to provide an image forming apparatus having excellent color characteristics, transmittancy, and polyvinyl chloride resistance, and which is capable of forming images without soiling the interior of the image forming apparatus, and particularly not contaminating the releasing oil coating the heating roller with coloring agent, even when said images are fixed using a heating roller fixing device.

These and other objects, advantages and features of the invention will become apparent from the following description thereof taken in conjunction with the accompanying drawings which illustrate specific embodiments of the invention.

DETAILED DESCRIPTION OF THE PREFERRED EMBODIMENTS

Figure 1:
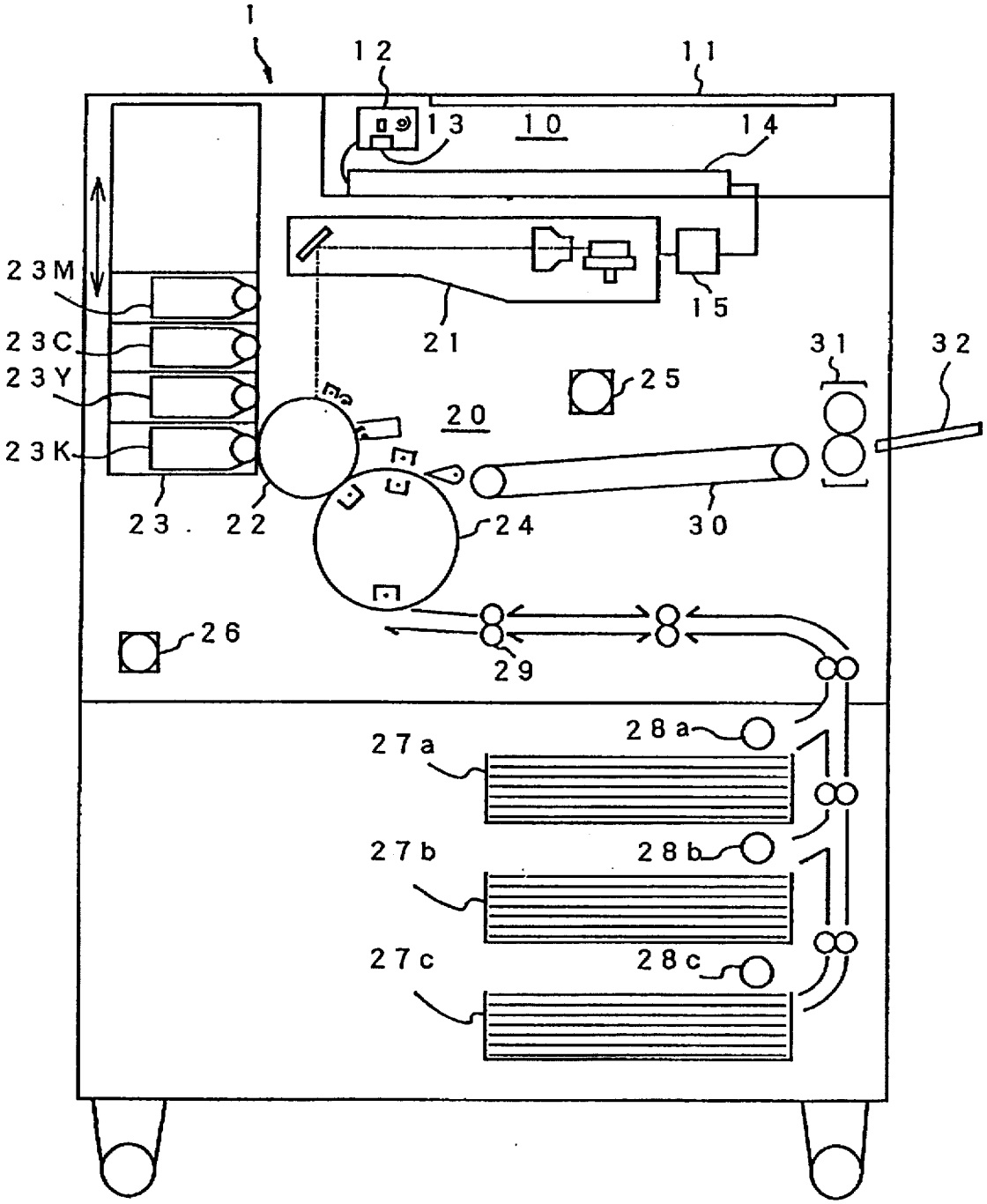
FIG. 1 shows the construction of an electrophotographic digital full-color copying apparatus.

A negative charging toner comprising at least specific polyester resin and specific yellow coloring agent is used as a yellow toner.

A negative charging toner comprising at least specific polyester resin and specific magenta coloring agent is used as a magenta toner.

Or a negative charging toner comprising at least specific polyester resin and two kinds of specific magenta coloring agents is used as a magenta toner.

Polyester resins useful as the binding resin for the color toners can be obtained by condensation polymerization of an acid constituent, and an aromatic diol represented by following general formula [I] as an alcohol constituent.

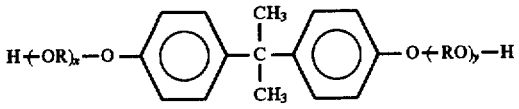

[I]

(Wherein R represents an ethylene radical or a propylene radical, and x and y represent integers of greater than 1; and the average of x+y is 2~7.)

Use of a polyester resin as a binder resin is advantageous inasmuch as a negative charge-controlling agent is not required when producing a negative charging toner because the polyester resin itself has negative charging properties, or when such additive is used, a very slight amount is sufficient. For example, when a styrene-acrylic resin is used, it is difficult to obtain both transmittancy and heat resistance characteristics to satisfactory degrees, with the result that the polyvinyl chloride resistance of the resin is reduced.

Examples of useful aromatic diols having the chemical structure represented by formula [I] above used in polyester resins include polyoxipropylene-bisphenol A such as bisphenol A propylene oxide, and polyoxyethylenebisphenol A such as bisphenol A etylene oxide.

Further examples of useful materials in addition to the aromatic diols are diols such as ethylene glycol, diethylene glycol, triethylene glycol, 1,2-propylene glycol, 1,3-propylene glycol, 1,4-butane diol, neopentyl glycol and the like, and polyvalent alcohols such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methyl propanetriol, 2-methyl-1,2,4-butanetriol, trimethylolethane, trimethylolpropane, 1,3,5-trihydroxy methylbenzene and the like.

Examples of useful acid constituents include aliphatic dicarboxylic acids and aromatic dicarboxylic acids.

Useful examples of the aliphatic dicarboxylic acids include aliphatic carboxylic acids such as fumaric acid, maleic acid, succinic acid, and alkyl- or alkenylsuccinic acid having 4~18 carbon atoms, as well as acid anhydrides and low-molecular alkyl esters thereof.

Examples of useful aromatic dicarboxylic acids include terephthalic acid, isophthalic acid and like aromatic dicarboxyalic acids, as well as acid anhydrides and low-molecular alkyl esters thereof. Furthermore, polyvalent carboxylic acids such as trimellitic acid and the like may be used in minute quantities to adjust the acid value of the resin insofar as the quantity does not produce a loss in toner transmittancy and the like. Examples of useful polyvalent carboxylic acid constituents include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexane tricarboxylic acid, 1,3-dicarboxyl-2-methyl-2-methylenecarboxy propane, 1,2,4-cyclohexane tricarboxylic acid, tetra(methylenecarboxyl) methane, 1,2,7,8-octane tetracarboxylic acid, pyromellitic acid and the like, as well as acid anhydrides and low-molecular alkyl esters thereof.

Among the alcohol constituents and acid constituents described above, it is desirable to use polyoxyethylene-bisphenol A and polyoxypropylene-bisphenol A in combination as aromatic diols, and aromatic dicarboxylic acid and aliphatic dicarboxylic acid as acid constituents to obtain linear polyester resin.

Desirable linear polyester resins have an acid value of 1.0~35.0 mgKOH/g; hydroxyl value of 10.0~40.0 mgKOH/g; molecular weight distributions measured by gel permeation chromatography (GPC) as follows: number-average molecular weight (Mn) of 3,000~10,000 and preferably 3,000~7,000; weight-average molecular weight (Mw) of 7,000~50,000 and preferably 7,000~15,000; molecular weight distribution (Mw/Mn) of 1.0~5.0 and preferably 1.5~3.0; endothermic peak value (Tg) of 50°~70° C. via DSC, and softening temperature (Tm) of 90°~110° C. via flow tester, and apparent melt viscosity at 90° C. of $1\times10^5$~$5\times10^6$ poise. When the above-mentioned requirements are not satisfied, there is concern that toner transmittancy, dispersion characteristics of an additive such as a coloring agent and a charge-controlling agent, fixing characteristics, and heat resistance characteristics cannot be adequately satisfied. Specifically, the negative charging characteristics of the toner can be improved by having the acid value in the range, and charging stability can be improved by having the hydroxyl (OH) value in the range. Toner sharp-melting characteristics are improved during fixing, and transmittancy is improved by having the molecular weight distribution within the range. The toner is provided adequate heat resistance and fixing characteristics by having the glass transition point and softening point within the ranges.

Linear polyester resins are soluble in tetrahydrofuran insofar as they do not contain constituents insoluble in tetrahydrofuran. It is undesirable that the linear polyester resin contains constituents which are insoluble in tetrahydrofuran, inasmuch as said constituents impair toner transmittancy.

Compounds classified as C.I. Solvent Yellow 162 is used as yellow coloring agent. This coloring agent has a stable chemical structure although it is a dye. Therefore, the coloring agent shows excellent resistance to solubility in silicon oil and sublimation resistance when heated during a heating roller fixing process, and produces images without soiling the interior of the image forming apparatus. And then, the coloring agent possesses superior characteristics for light resistance. When C.I. Solvent Yellow 162 is combined with the linear polyester resin, yellow toner is produced which has excellent coloring agent dispersion and transmittancy, and excellent fixing characteristics and heat resistance.

C.I. Solvent Yellow 162 is used in a ratio of 0.5~10 parts-by-weight (hereinafter "pbw"), and preferably 1.0~4.0 pbw relative to 100 pbw of binder resin. When less than 0.5 pbw of C.I. Solvent Yellow 162 is used, adequate image density cannot be obtained, whereas when more than 10 pbw are used, toner transmittancy is reduced, thereby adversely affecting color tone and chargeability.

Anthraquinone dye having the following general formula [II], or quinacridone pigment combined with common anthraquinone dye including anthraquinone dye represented by the formula [II].

[II]

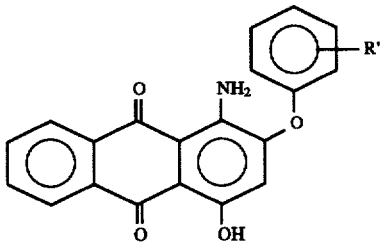

(Wherein R' represents an hydroxyalkyl group, alkoxyalkyl group, alkylaminosulfonyl group, alkoxyalkylaminosulfonyl group, alkylcarboxyalkyl group.)

Normally, 1-amino group among the structures which concerns anthraquinone dyes coloring is thermically unstable. Although breakdown of this group is the cause of deteriorating color resistance, in anthraquinone dyes having the formula [II], the nitrogen atoms of 1-amino group are chemically stabilized by the presence of 2-phenoxy group, and is believed to improve heat resistance. Furthermore, it is believed that solubility in silicon oil is obstructed by the presence of the substituted radical R', and sublimation resistance is superior because overall molecular weight can be increased. Accordingly, toner using the anthraquinone dye has excellent solubility resistance in silicon oil and sublimation resistance during the heating in the heating roller fixing process, as well as excellent light resistance, and can be achieve image formation without soiling the interior of the apparatus. Combining the above-described anthraquinone dye with specific linear polyester resin provides a magenta toner having excellent transmittancy due to the superior coloring agent dispersion (solubility), as well as excellent fixing characteristics and heat resistance.

Materials useful as the anthraquinone dyes having the formula [II] include, for example, materials (a)~(f) below, but are not limited to said materials.

(a)

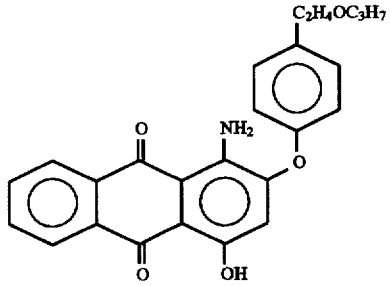

(b)

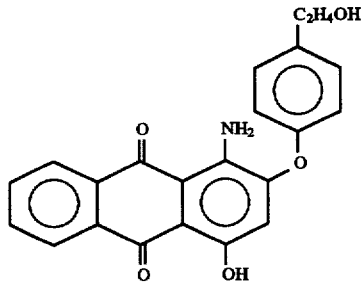

(c)

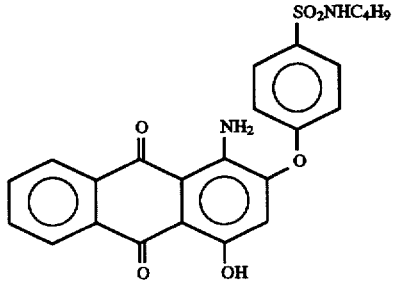

-continued

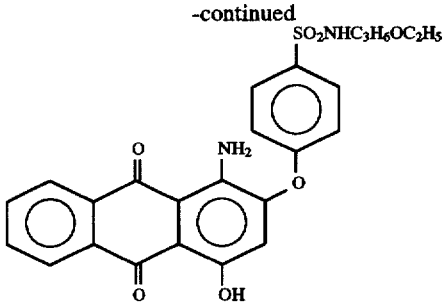

(d)

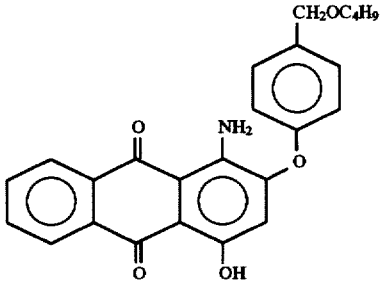

(e)

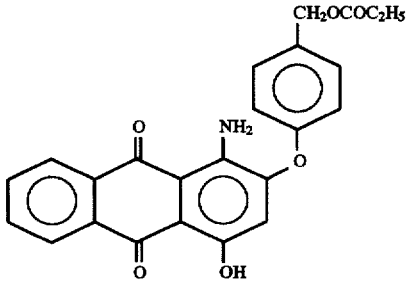

(f)

Among the above anthraquinone dyes represented by formula [II], materials having a molecular weight greater than 400 are used, but solubility resistance in silicon oil as well as sublimation resistance is superior. An example of such material usable as the aforesaid anthraquinone dye is EX-59 (Mitsui Toatsu Chemical, Inc).

The amount of blow-off triboelectric charge to an iron powder which passes 150 mesh and doesn't pass 250 mesh of the aforesaid anthraquinone dye is −1—20 μC/g, and excellent negative charging characteristics are provided the toner in combination with the previously mentioned polyester resin.

When anthraquinone magenta dye and quinacridone magenta pigment are used together, sharpness and transmittancy are improved for overhead projector transparencies which cannot be attained only with magenta pigments by using the anthraquinone magenta dye. Furthermore, reproduction of the secondary color reproduction range (color reproduction range by mixing yellow toner, cyan toner, and black toner) can be increased by using a quinacridone magenta pigment to the extent that is difficult to achieve by a toner using only anthraquinone dye.

In magenta toners including only anthraquinone magenta dye as a coloring agent, there is margin for improvement in secondary color reproducibility. For example, although blue color reproducibility in secondary color reproducibility with cyan toner and skin tone reproducibility have achieved practical levels, further better secondary color reproducibility is desired. On the other hand, when quinacridone magenta pigment is used alone as a coloring agent, image fogging occurs and negative charging of the toner is adversely affected by the positive charging characteristics of the quinacridone pigment. Furthermore, inadequate sharpness and transmittancy is obtained for overhead projector transparencies, and adequate secondary color reproducibility is not obtained.

In contrast, combined use of anthraquinone dye and quinacridone pigment can improve sharpness and secondary color reproducibility for overhead projection transparencies, and can eliminate adverse effects on toner charging via the anthraquinone dye which has negative charging characteristics to counteract the positive charging characteristics of the quinacridone pigment.

Although commonly available materials are usable as the quinacridone pigment, C.I. Pigment Red 122 is particularly desirable, e.g., Hostaperm Pink EB Toner grade VP2301 (Hoechst Industry Co.) can be used.

These magenta coloring agents are used at a ratio of 0.5~10 pbw, and preferably, 1.0~4.0 pbw, relative to 100 pbw of binder resin. When the amount of magenta coloring agent used is less than 0.5 pbw, suitable image density cannot be obtained, whereas when more than 10 pbw is used, toner transmittancy is reduced, thereby undesirably affecting color tone and charging characteristics.

The proportion of anthraquinone dye to quinacridone pigment is 9:1~1:3, and preferably within the range of 4:1~1:1.

Additives other than the coloring agents may also be added to the toner, e.g., charge-controlling agents and the like.

Colorless, white, or light color negative charge-controlling agents may be used, e.g., salicylic acid metal complexes such as zinc complexes and the like of salicylic acid derivatives, calix arene compounds, quaternary aluminum salt compounds containing fluorine and like negative charge-controlling agents may be used. Examples of useful salicylic acid metal complexes are disclosed in, for example, Japanese Patent Publication Nos. SHO 53-127726 and SHO 62-145255, examples of useful calix arene compounds are disclosed in, for example, Japanese Patent Publication No. HEI 2-201278, and examples of useful quaternary aluminum salt compounds containing fluorine are disclosed in, for example, Japanese Patent Publication No. HEI 3-1162.

In order to improve the electrification build-up characteristics and regulation of the toner charge, quaternary aluminum salt compounds containing fluorine may be used in combination with charge-controlling agents such as salicylic acid metal complexes and calix arene compounds and the like.

When such charge-controlling agents are added, the ratio of such addition is 0.1~10 pbw, and preferably 0.5~4.0 pbw relative to 100 pbw of binding resin.

Fluidization agents may be added to improve toner flowability.

Examples of useful fluidization agents include silica, alumina, titanium, tin oxide, zirconium oxide and the like used singly or in combinations of two or more.

It is desirable that fluidization agents are subjected to undergo a treatment for impartation of hydrophobicity from the standpoint of environmental stability. Examples of useful hydrophobic agents include various types of coupling agents such as silane, titanate, aluminum, zirco-aluminate and the like, and silicon oil.

It is desirable that hydrophobic titania, hydrophobic silica and hydrophobic alumina may be used as fluidization agents from the standpoint of flowability and the environmental stability of the charge. The amount of added fluidization agent is preferably 0.3~2.0 percent-by-weight relative to the toner.

The polyester resin and coloring agents and other desired constituents are kneaded and pulverized in the toner during manufacture, which is preferable from the perspective of production cost and production stability. Kneading-pulverization methods manufacture toner by processes including mixing toner constituents of resin, coloring agents and the like via a mixing machine such as a Henschel mixer or the like, fusion-kneading said mixture, coarse pulverization of said kneaded material after cooling, fine pulverization of said coarsely pulverized particles, and classification of said finely pulverized particles.

The toners of the present invention are regulated to achieve a volumetric mean particle size of 4~9 μm, which is desirable from the perspective of high precision image reproducibility.

The toner is mixed with a carrier and used in a two-component developer. However, the toners of the present invention are not limited to use in two-component developers and may also be used as a monocomponent developer without using a carrier.

The carrier used in combination with the toners may be commonly known carriers conventionally used in two-component developers. For example, carriers comprising magnetic particles such as iron, ferrite or the like, resin-coated carriers comprising such magnetic particles with an overcoating of resin, or binder-type carriers comprising fine magnetic particles dispersed in resin may be used. Among these carriers, resin-coated carriers using a polyester resin or copolymer resin (graft resin) comprising organopolysiloxane and vinyl monomers, and silicon resin as a protective coating resin, or resin-coated carrier using polyester resin, or binder-type carrier comprising polyester resin as a binding resin are desirable from the perspective of toner consumption and the like. The mean particle size of the carrier is preferably 30~60 μm.

Specific examples of toner composition and manufacturing methods as well as characteristics of the toners are described via experimental evaluations hereinafter.

<Yellow Toner 1 Manufacture and Evaluation>

Bisphenol A propylene oxide (PO) and bisphenol A ethylene oxide (EO) as alcohol constituents, and fumaric acid (FA) and terephthalic acid (TPA) as acid constituents were condensed in the molar ratio shown in Table 1 below to obtain linear polyester resin (acid value: 3.1 mgKOH/g; hydroxyl (OH) value: 31.7 mgKOH/g; number-average molecular weight (Mn): 6500; weight-average molecular weight (Mw): 15000; Mw/Mn: 2.3; glass transition point: 58.4° C.; softening point: 95.2° C.; apparent melt viscosity at 90° C.: $4.0\times10^5$ poise) which was without constituents insoluble in tetrahydrofuran. To 100 pbw of the aforesaid linear polyester resin were added 2.5 pbw of C.I. Solvent Yellow 162 (Neopen Yellow 075: BASF), and 2.0 pbw zinc complex of salicylic acid derivative (E-84: Orient Chemical Co., Ltd.) as a charge-controlling agent. The materials were suitably mixed using a Henschel mixer, then kneaded by dual-shaft extrusion kneader and subsequently cooled. The obtained mixture was coarsely pulverized by feather mill, and thereafter finely pulverized by a jet pulverizer. The obtained finely pulverized material was classified to obtain toner particles having a volumetric mean particle size of 7.9 μm, and number-average particle size of 6.9 μm.

TABLE 1

| | Alcohol Components | | | Acid Components | | | |
|---|---|---|---|---|---|---|---|
| | PO | EO | DEG | FA | SA | TPA | TMA |
| Yellow Toner 1 | 5.0 | 5.0 | — | 5.0 | — | 4.9 | — |
| Yellow Toner 2 | 5.0 | 5.0 | — | — | 2.0 | 7.0 | — |
| Yellow Toner 3 | 2.5 | 7.5 | — | 5.5 | — | 5.0 | — |
| Yellow Toner 4 | — | 8.0 | 2.0 | — | — | 9.0 | — |
| Yellow Toner 5 | 10 | — | — | — | 2.0 | 7.0 | 1.0 |
| Yellow Toner 6 | 7.0 | — | — | — | 2.5 | 5.5 | 2.0 |

To 100 pbw of the toner particles were added 0.6 pbw of silica fine powder (CH1303: Hoechst Co.), and 0.4 pbw titanium oxide powder (400BS: Teika K.K.), and the mixture was mixed in a Henschel mixer to obtain yellow toner 1.

The acid value of the resin was determined in the manner described below. First, 2~10 g of resin were weighed, and dissolved in 50 ml of toluene. Using 0.1% bromothymol blue and phenol red indicator, a standard N/10 sodium hydroxide/alcohol solution prepared beforehand was titrated, and the acid value calculated from the amount of said standard N/10 sodium hydroxide/alcohol solution consumed.

$$\text{Acid value}=5.61[mg]\times\text{KOH}\ [ml]\times N/(\text{amount of resin}\ [mg])$$

Molecular weight distribution was measurered by a gel permeation chromatograph model 807-1 (Japan Bunkou Kogyo, K.K.). Nonaqueous chromatographic column was maintained at 40° C. with the column open, and tetrahydrofuran was allowed to flow therethrough as a carrier solvent at 1 kg/cm$^2$. Thirty milligrams of the resin was dissolved in 20 ml of tetrahydrofuran, and 0.5 ml of this solution was introduced into the apparatus together with the carrier solvent. The molecular weight was determined by polystyrene conversion.

The glass transition point was measured using a scanning calorimeter model DSC-200 (Seiko Electronics). The toner was precisely weight at 5~20 mg, and preferably 10 mg, and placed in an aluminum pan; alumina was added to an aluminum pan as a reference. The material was heated at a rate of 30° C./min from room temperature to 200° C., and cooled after melt-quenching; measurements were made between 20°~120° C. with temperature rise of 10° C./min. In the temperature elevation process, the endothermic peak temperature having a main peak in the range of 30°~80° C. was set as the endothermic peak value (glass transition point).

Softening point and apparent melt viscosity were measured using a flow tester model CFT-500 (Shimadzu Seisakusho K.K.). Toner was weighed at 1.0~1.5 g, and subjected to pressure of 180 kg/cm$^2$ for one minute using a molding device. The pressed sample was measured by flow tester under the conditions described in Table 2 below. The temperature when the sample was at ½ the flow rate was set as the softening temperature, and the apparent melt viscosity at 90° C. was determined from the temperature-apparent viscosity curve.

TABLE 2

| | |
|---|---|
| RATE TEMP | 3.0° C./min |
| SET TEMP | 50.0° C. |
| MAX TEMP | 120.0° C. |
| INTERVAL | 2.0° C. |

TABLE 2-continued

| | |
|---|---|
| PREHEAT | 180.0 sec |
| LOAD | 30.0 kgf |
| DIE(DIA) | 1.0 mm |
| DIE(LENG) | 1.0 mm |
| PLUNGER | 1.0 $cm^2$ |

A polyester resin-coated ferrite carrier was manufactured, and the carrier and the yellow toner 1 were mixed to achieve a toner density of 8 percent-by-weight, so as to obtain a two-component developer.

Carrier Manufacture

A polyester resin solution comprising ethylene glycol and neopentyl glycol as alcohol constituents, and isophthalic acid and terephthalic acid as acid constituents was applied on Cu—Zn ferrite particles having a mean particle size of 45 μm and dried thereon so as to achieve an application layer of 0.4 percent-by-weight, and then cracked to obtain a polyester resin-coated ferrite carrier.

The developer is used, for example, in the full-color copying machine (model CF-80; Minolta Co., Ltd.) of FIG. 1. The construction of the copying machine and the image forming process is described below.

FIG. 1 shows the structure of the above-noted digital full-color copying machine. This machine includes reading portion 10 for reading an image from an original document and printer portion 20 for forming an image on a recording medium.

In reading portion 10, scanner 12 moves downwardly along document platen 11 and scans the image surface of an original document placed on document platen 11, and after image sensor (CCD) 13 photoelectrically converts the reflected image light to red (R), green (G), and blue (B) components, image signal processing unit 14 executes predetermined image processing to produce digital image data which comprises cyan (C), magenta (M), yellow (Y), and black (Bk). Said image data are stored in buffer memory 15.

Printer portion 20 mainly comprises laser generator 21, organic photosensitive drum 22, developing unit 23, paper feed cassettes *27a*, *27b*, and *27c*, manual paper feeder 28, conveyor belt 30, transfer drum 24, and fixing unit 31.

Laser generator 21 sequentially emits a laser beam based on C, M, Y, and Bk image data stored in buffer memory 15 to photosensitive drum 22.

The laser beam emitted from laser generator 21 scans the surface of photosensitive drum 22 which is uniformly and negatively charged by charger 41 and rotates at constant speed. Thus, an electrostatic latent image corresponding to the aforesaid digital image data is formed on the surface of the photosensitive drum 22.

The aforesaid electrostatic latent image is developed by toner from developing unit 23, and said toner image is subsequently transferred to a recording medium adhered to the surface of transfer drum 24, as described hereinafter.

Developing unit 23 comprises four developing devices 23M, 23C, 23Y, 23K which respectively accommodate developers incorporating magenta toner, cyan toner, yellow toner, and black toner. Typically, commercial, negative charge color toner (full-color toner (magenta, yellow, cyan, black) for model CF-80; Minolta Co., Ltd.) is used in each developing device. The previously described yellow toner 1 was loaded in developing device 23Y. Developing unit 23 is constructed to move vertically, and a specified developing device is positioned at a developing position confronting photosensitive drum 22.

The recording medium is fed from manual paper feeder 28 or paper feed cassette *27a*, *27b*, or *27c* and advanced toward the transfer drum 24 via a group of rollers until said recording medium is wrapped around transfer drum 24.

A laser beam irradiates the surface of photosensitive drum 22 previously uniformly charged in accordance with cyan image data stored in buffer memory 15. Then, developing device 23C is disposed at the developing position, and development by cyan toner is accomplished. That is, development is accomplished using a toner having the same polarity as the charge on the surface of the photosensitive drum (reversal development). The cyan toner image formed on the surface of photosensitive drum 22 is transferred onto the recording medium adhered to transfer drum 24.

Then, the surface of the photosensitive drum 22 is again uniformly charged, and irradiated by a laser beam in accordance with magenta image data. Developing device 23M is disposed at the developing position, and development is accomplished. The magenta toner image formed on the surface of photosensitive drum 22 is transferred so as to be overlaid on the cyan toner image on the recording medium adhered to transfer drum 24.

Thereafter, identical processes are executed for the yellow image and black image, which are sequentially overlaid on the recording medium adhered to transfer drum 4. When the aforesaid overlays are complete, the recording medium is peeled from the transfer drum 24, and the recording medium is subjected to an image fixing process by fixing unit 31.

Fixing unit 31 is provided with a heating roller including a silicone rubber layer formed on a primer layer on a metal core of aluminum or the like and having a built in heater, pressure roller including a silicone rubber layer formed on a primer layer on a metal core of aluminum or the like having a built in heater, and an oil applicator unit for applying silicone oil to the heating roller. The heating roller and pressure roller of fixing unit 31 apply contact pressure one upon another. After passing between the fixing rollers, the recording medium is ejected into paper ejection tray 32.

Filler such as silica or the like may be added to the silicone rubber layer on the surfaces of the pressure roller and heating roller. Rollers having a single layer construction, or double layer or triple layer construction may be used.

Fifty thousand copies were made in experiments using a yellow document, the previously described developer, and a full-color copy machine (model CF-80; Minolta Co., Ltd.).

The silicone rubber layer on the fixing roller was visually inspected. No evidence of yellow color was found, and there was a complete absence of offset to the fixing roller.

Figure 2:
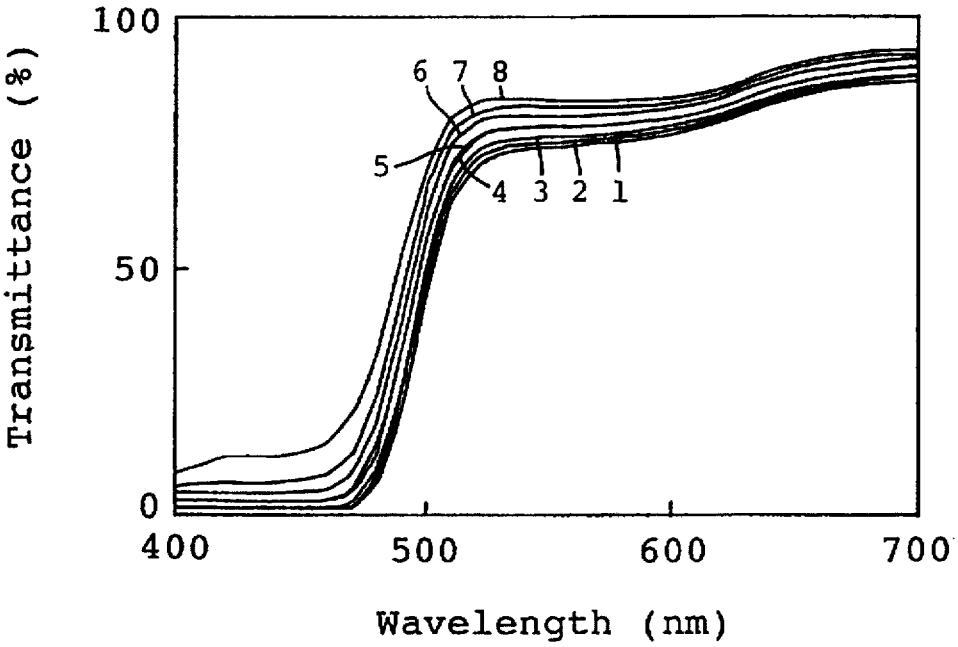
FIGS. 2 and 3 are illustrations showing the spectral reflectance of an embodiment of a yellow toner.

The color of the obtained copy image was vivid yellow and had sufficient yellow toner color. The amount of adhered toner was varied, and a plurality of toner images were formed, and the spectral reflectance of said images were measured using a CM-1000 (Minolta Co., Ltd.); the measurement results are shown in FIG. 2. In FIG. 2, reference numbers 1~8 refer to spectral reflectance curves when the amount of adhered toner was 0.30, 0.44, 0.59, 0.74, 0.86, 0.94, 1.12, and 1.24 $mg/cm^2$, respectively.

From FIG. 2, it can be understood that even when large amounts of toner are adhered, transmittance is reduced at 400~460 nm, and the slope of transmittance at 460~520 nm keeps large. When images were output on OHP transparencies to view transmission characteristics of the copy images projected by a overhead projector headlamp, no shadows were observed in the entire range including halftones. The copy images had excellent OHP transmittancy.

Force exposure tests were conducted using a fade meter to ascertain light resistance characteristics of the copies. There was no discernable discoloration of the yellow color even after 12 hr exposure. Light resistance was therefore deemed suitable for practical use.

Furthermore, there was no soiling in the vicinity of the ejection port or in the interior of the copying machine, which is an extremely desirable characteristics when used in copy machines.

<Yellow Toner 2 Manufacture and Evaluation>

Yellow toner 2 was produced in the same manner as yellow toner 1 with the exception that bisphenol A propylene oxide (PO) and bisphenol A ethylene oxide (EO) as alcohol constituents, and alkenylsuccinic acid (SA) and terephthalic acid (TPA) as acid constituents were condensed in the molar ratio shown in Table 1 to obtain linear polyester resin (acid value: 5.7 mgKOH/g; hydroxyl (OH) value: 23.1 mgKOH/g; number-average molecular weight (Mn): 7000; weight-average molecular weight (Mw): 12600; Mw/Mn: 1.8; glass transition point: 57.7° C.; softening point: 95.6° C.; apparent melt viscosity at 90° C.: $4.5\times10^5$ poise) which was without constituents insoluble in tetrahydrofuran. Yellow toner 2 was used in a developer under the same conditions as yellow toner 1, and evaluated. Color tone and transmittancy were invariably satisfactory. Fixing roller staining and soiling in the interior of the copying machine are practically satisfactry.

<Yellow Toner 3 Manufacture and Evaluation>

Yellow toner 3 was produced in the same manner as yellow toner 1 with the exception that bisphenol A propylene oxide (PO) and bisphenol A ethylene oxide (EO) as alcohol constituents, and fumaric acid (FA) and terephthalic acid (TPA) as acid constituents were condensed in the molar ratio shown in Table 1 to obtain linear polyester resin (acid value: 24.9 mgKOH/g; hydroxyl (OH) value: 19.1 mgKOH/g; number-average molecular weight (Mn): 6700; weight-average molecular weight (Mw): 12000; Mw/Mn: 1.8; glass transition point: 58.3° C.; softening point: 92.8° C.; apparent melt viscosity at 90° C.: $2.1\times10^5$ poise) which was without constituents insoluble in tetrahydrofuran, and 3.2 pbw of calix arene compound (E-89; Orient Kagaku Kogyo K.K.) used as a charge-controlling agent. Yellow toner 3 was used in a developer under the same conditions as yellow toner 1, and evaluated. Color tone and transmittancy were invariably satisfactory. Fixing roller staining and soiling in the interior of the copying machine are practically satisfactry.

<Yellow Toner 4 Manufacture and Evaluation>

Yellow toner 4 was produced in the same manner as yellow toner 1 with the exception that bisphenol A ethylene oxide (EO) and diethylene glycol (DEG) as alcohol constituents, and terephthalic acid (TPA) and as an acid constituent were condensed in the molar ratio shown in Table 1 to obtain linear polyester resin (acid value: 2.7 mgKOH/g; hydroxyl (OH) value: 30.3 mgKOH/g; number-average molecular weight (Mn): 5700; weight-average molecular weight (Mw): 12400; Mw/Mn: 2.2; glass transition point: 56.4° C.; softening point: 93.6° C.; apparent melt viscosity at 90° C.: $2.8\times10^5$ poise) which was without constituents insoluble in tetrahydrofuran. Yellow toner 4 was used in a developer under the same conditions as yellow toner 1, and evaluated. Color tone and transmittancy were invariably satisfactory. Fixing roller staining and soiling in the interior of the copying machine are practically satisfactry.

<Yellow Toner 5 Manufacture and Evaluation>

Yellow toner 5 was produced in the same manner as yellow toner 1 with the exception that bisphenol A propylene oxide (PO) as an alcohol constituent, and alkenylsuccinic acid, terephthalic acid (TPA), and trimellitic acid as acid constituents were condensed in the molar ratio shown in Table 1 to obtain linear polyester resin (acid value: 15.6 mgKOH/g; hydroxyl (OH) value: 28.5 mgKOH/g; number-average molecular weight (Mn): 3900; weight-average molecular weight (Mw): 8200; Mw/Mn: 2.1; glass transition point: 59.2° C.; softening point: 95.7° C.; apparent melt viscosity at 90° C.: $5.0\times10^5$ poise) which was without constituents insoluble in tetrahydrofuran. Yellow toner 5 was used in a developer under the same conditions as yellow toner 1, and evaluated. Color tone and transmittancy were invariably satisfactory. Fixing roller staining and soiling in the interior of the copying machine are practically satisfactry.

<Yellow Toner 6 Manufacture and Evaluation>

Yellow toner 6 was produced in the same manner as yellow toner 1 with the exception that bisphenol A propylene oxide (PO) and bisphenol A ethylene oxide (EO) as alcohol constituents, and alkenylsuccinic acid, terephthalic acid (TPA), and trimellitic acid as acid constituents were condensed in the molar ratio shown in Table 1 to obtain linear polyester resin (acid value: 32.3 mgKOH/g; hydroxyl (OH) value: 33.1 mgKOH/g; number-average molecular weight (Mn): 4400; weight-average molecular weight (Mw): 8400; Mw/Mn: 1.9; glass transition point: 56.9° C.; softening point: 95.1° C.; apparent melt viscosity at 90° C.: $4.0\times10^5$ poise) which was without constituents insoluble in tetrahydrofuran. Yellow toner 6 was used in a developer under the same conditions as yellow toner 1, and evaluated. Color tone and transmittancy were invariably satisfactory. Fixing roller staining and soiling in the interior of the copying machine are practically satisfactry.

<Yellow Toner 7 Manufacture and Evaluation>

Figure 3:
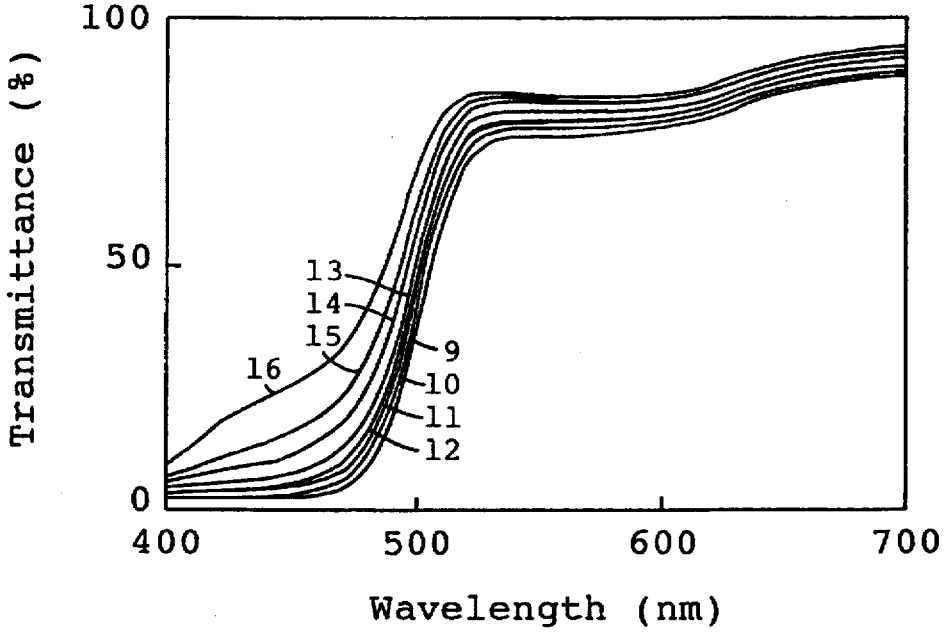

Yellow toner 7 was produced in the same manner as yellow toner 1 with the exception that 3 pbw benzidine yellow pigment (C.I. Pigment Yellow 17) was used as a coloring agent. When a developer was produced and image output tested in the same manner as described for toner 1, superior characteristics were obtained for fixing roller staining and copy machine operation. However, when transmittance was measured for a plurality of images with different amounts of adhered toner, it was found that when large amounts of toner were adhered, transmittance was increased at 400~460 nm, and the slope of transmittance fell off near 500 nm, as shown in FIG. 3. In FIG. 3, reference numbers 9~16 refer to spectral reflectance curves when the amount of adhered toner was 0.24, 0.38, 0.49, 0.63, 0.72, 0.83, 0.97, and 1.10 mg/cm$^2$, respectively. When images were output on OHP transparencies to view transmission characteristics of the copy images projected by a overhead projector headlamp, shadows were observed, and sharp yellow color reproduction was not obtained.

<Yellow Toner 8 Manufacture and Evaluation>

Yellow toner 8 was produced in the same manner as yellow toner 1 with the exception that 3.0 pbw anthraquinone yellow pigment (TON yellow EX-148: Mitsui Toatsu chemical, Inc.) was used as a coloring agent. When a developer was produced and image output tested in the same manner as described for yellow toner 1, copy image color tone and transmittancy were superior, but widespread fogging and toner dispersion were also present.

After printing 5,000 copies, the fixing oil and fixing roller were visually examined, and yellow color adhesion was noted to the extent that conditions sufficient for continued use were not present.

<Magenta Toner 1 Manufacture and Evaluation>

Bisphenol A propylene oxide (PO) and bisphenol A ethylene oxide (EO) as alcohol constituents, and fumaric acid (FA) and terephthalic acid (TPA) as acid constituents were condensed in the molar ratio shown in Table 3 below to obtain linear polyester resin (acid value: 3.1 mgKOH/g; hydroxyl (OH) value: 31.7 mgKOH/g; number-average molecular weight (Mn): 6500; weight-average molecular weight (Mw): 15000; Mw/Mn: 2.3; glass transition point: 58.4° C.; softening point: 95.2° C.; apparent melt viscosity at 90° C.: $4.0\times10^5$ poise) which was without constituents insoluble in tetrahydrofuran. To 100 pbw of the aforesaid linear polyester resin were added 2.5 pbw of anthraquinone stain having the aforesaid chemical structural formula [II] (TON. Red. EX-59: Mitsui Toatsu Chemicals, Inc.), and 2.0 pbw zinc complex of salicylic acid derivative (E-84: Orient Chemical Co., Ltd.) as a charge-controlling agent. The materials were suitably mixed using a Henschel mixer, then kneaded by dual-shaft extrusion kneader and subsequently cooled. The obtained mixture was coarsely pulverized by feather mill, and thereafter finely pulverized by a jet pulverizer. The obtained finely pulverized material was classified to obtain toner particles having a volumetric mean particle size of 7.9 μm, and number-average particle size of 6.9 μm.

TABLE 3

| | Alcohol Components | | | Acid Components | | | |
|---|---|---|---|---|---|---|---|
| | PO | EO | DEG | FA | SA | TPA | TMA |
| Magenta Toner 1 | 5.0 | 5.0 | — | 5.0 | — | 4.0 | — |
| Magenta Toner 2 | 5.0 | 5.0 | — | — | 2.0 | 7.0 | — |
| Magenta Toner 3 | 2.5 | 7.5 | — | 5.5 | — | 5.0 | — |
| Magenta Toner 4 | — | 8.0 | 2.0 | — | — | 9.0 | — |
| Magenta Toner 5 | 10 | — | — | — | 2.0 | 7.0 | 1.0 |
| Magenta Toner 6 | 7.0 | 3.0 | — | — | 2.5 | 5.5 | 2.0 |

To 100 pbw of the aforesaid toner particles were added 0.6 pbw of silica powder (H1303: Hoechst Co. Ltd.), and 0.4 pbw titanium oxide powder (400BS: Teika K.K.), and the mixture was mixed in a Henschel mixer to obtain magenta toner 1.

Resin acid value, molecular weight distribution, glass transition point, softening temperature, and apparent melt viscosity were measured in the same manner as described for yellow toner 1.

Blow-off triboelectric charging was measured using blow-off measuring device model TB-200 (Toshiba Chemical Co., Ltd.). First, 30 g of iron carrier particles which pass 150 mesh and don't pass 250 mesh and 0.3 g coloring agent were introduced into a 20 ml of polyester bottle and mixed for 10 min with a roll mill. To a gauge provided with a 400 mesh wire net was added 0.5 g of said mixture, and the amount of triboelectric charge was measured after 1 min flow under nitrogen gas at a blow pressure of 1 kgf/cm$^2$.

Developer was produced in the same manner as described for yellow toner 1, and said developer was used in the previously mentioned full-color copy machine (model CF-80: Minolta Co., Ltd.) with a magenta document to experimentally produce 50,000 output images. Reduction in image quality due to change in image density, increased image fogging and the like did not occur, and the output images were observed to have excellent characteristics.

The fixing roller and silicone oil were visually examined, and there was no trace found of magenta color adhesion or offset to the fixing roller.

Figure 4:
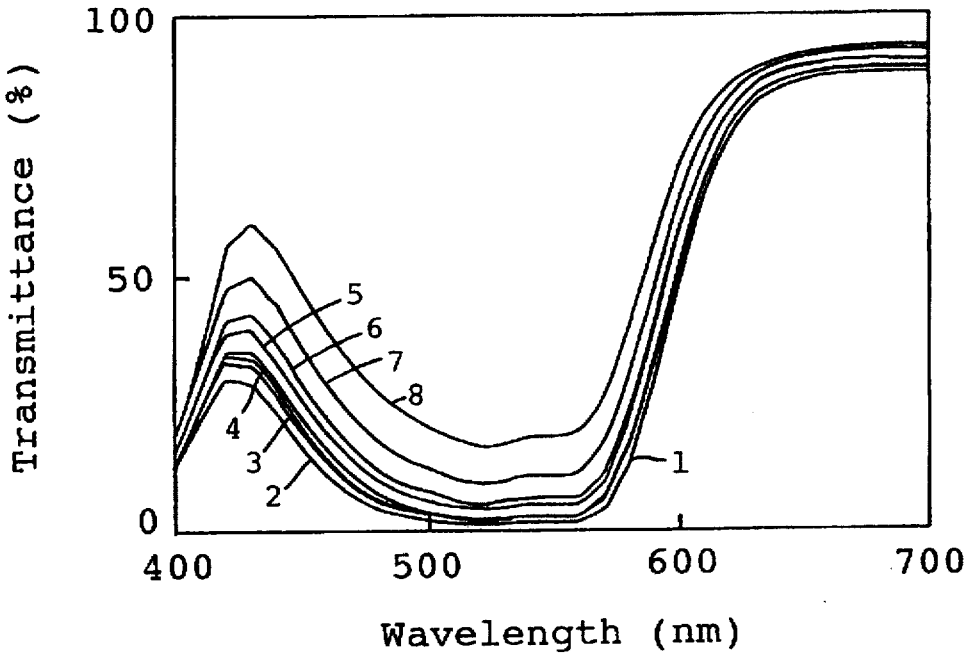
FIGS. 4 and 5 are illustrations showing the spectral reflectance of an embodiment of a magenta toner.

The coloration of the obtained copy images was a sharp magenta color, and suitable for use as a magenta toner. The amount of adhered toner was varied and a plurality of toner images formed, and the spectral transmittance of said images was measured by a model CM-1000 measuring device (Minolta Co., Ltd.); the measurement results are shown in Table 4. In FIG. 4, reference numbers 1~8 refer to spectral transmittance curves when the amount of adhered toner was 0.36, 0.60, 0.82, 0.97, 1.15, 1.22, 1.31, and 1.40 mg/cm$^2$, respectively.

It can be understood from FIG. 4 that even when the large amounts of toner are adhered, transmittance is reduced at 500~560 nm, and the slope of transmittance at 560~620 nm keeps large. when images were output on OHP transparencies to view transmission characteristics of the copy images projected by a overhead projector headlamp, no shadows were observed in the entire range including halftones. The copy images had excellent OHP transmittancy.

Force exposure tests were conducted using a fade meter to ascertain light resistance characteristics of the copies. There was no discernable discoloration of the yellow color even after 12 hr exposure. Light resistance was therefore deemed suitable for practical use.

Furthermore, there was no soiling in the vicinity of the ejection port or in the interior of the apparatus, which is an extremely desirable characteristics when used in copy machines.

<Magenta Toner 2 Manufacture and Evaluation>

Magenta toner 2 was produced in the same manner as magenta toner 1 with the exception that bisphenol A propylene oxide (PO) and bisphenol A ethylene oxide (EO) as alcohol constituents, and alkenylsuccinic acid (SA) and terephthalic acid (TPA) as acid constituents were condensed in the molar ratio shown in Table 3 to obtain linear polyester resin (acid value: 5.7 mgKOH/g; hydroxyl (OH) value: 23.1 mgKOH/g; number-average molecular weight (Mn): 7000; weight-average molecular weight (Mw): 12600; Mw/Mn: 1.8; glass transition point: 57.7° C.; softening point: 95.6° C.; apparent melt viscosity at 90° C.: $4.5\times10^5$ poise) which was without constituents insoluble in tetrahydrofuran. Magenta toner 2 was used in a developer produced in the same manner as described for magenta toner 1 and evaluated. Color tone and transmittancy were invariably satisfactory. Fixing roller staining and soiling in the interior of the copying machine are practically satisfactry.

<Magenta Toner 3 Manufacture and Evaluation>

Magenta toner 3 was produced in the same manner as magenta toner 1 with the exception that bisphenol A propylene oxide (PO) and bisphenol A ethylene oxide (EO) as alcohol constituents, and fumaric acid (FA) and terephthalic acid (TPA) as acid constituents were condensed in the molar ratio shown in Table 3 to obtain linear polyester resin (acid value: 24.9 mgKOH/g; hydroxyl (OH) value: 19.1 mgKOH/g; number-average molecular weight (Mn): 6700; weight-average molecular weight (Mw): 12000; Mw/Mn: 1.8; glass transition point: 58.3° C.; softening point: 92.8° C.; apparent melt viscosity at 90° C.: $2.1\times10^5$ poise) which was without constituents insoluble in tetrahydrofuran, and 3.2 pbw of calix arene compound (E-89: Orient Kagaku Kogyo K.K.) was added as a charge-controlling agent. Magenta toner 3 was used in a developer produced in the same manner as described for magenta toner 1 and evaluated. Color tone and transmittancy were invariably satisfactory. Fixing roller staining and soiling in the interior of the copying machine are practically satisfactry.

<Magenta Toner 4 Manufacture and Evaluation>

Magenta toner 4 was produced in the same manner as magenta toner 1 with the exception that bisphenol A ethylene oxide (EO) and diethylene glycol (DEG) as alcohol constituents, and terephthalic acid (TPA) as an acid constituent were condensed in the molar ratio shown in Table 3 to obtain linear polyester resin (acid value: 2.7 mgKOH/g; hydroxyl (OH) value: 30.3 mgKOH/g; number-average molecular weight (Mn): 5700; weight-average molecular weight (Mw): 12400; Mw/Mn: 2.2; glass transition point: 56.4° C.; softening point: 93.6° C.; apparent melt viscosity at 90° C.: $2.8\times10^5$ poise) which was without constituents insoluble in tetrahydrofuran. Magenta toner 4 was used in a developer produced in the same manner as described for magenta toner 1 and evaluated. Color tone and transmittancy were invariably satisfactory. Fixing roller staining and soiling in the interior of the copying machine are practically satisfactry.

<Magenta Toner 5 Manufacture and Evaluation>

Magenta toner 5 was produced in the same manner as magenta toner 1 with the exception that bisphenol A propylene oxide (PO) as an alcohol constituent, and alkenylsuccinic acid, terephthalic acid (TPA), and trimellitic acid as acid constituents were condensed in the molar ratio shown in Table 2 to obtain linear polyester resin (acid value: 15.6 mgKOH/g; hydroxyl (OH) value: 28.5 mgKOH/g; number-average molecular weight (Mn): 3900; weight-average molecular weight (Mw): 8200; Mw/Mn: 2.1; glass transition point: 59.2° C.; softening point: 95.7° C.; apparent melt viscosity at 90° C.: $5.0\times10^5$ poise) which was without constituents insoluble in tetrahydrofuran. Magenta toner 5 was used in a developer produced in the same manner as described for magenta toner 1 and evaluated. Color tone and transmittancy were invariably satisfactory. Fixing roller staining and soiling in the interior of the copying machine are practically satisfactry.

<Magenta Toner 6 Manufacture and Evaluation>

Magenta toner 6 was produced in the same manner as magenta toner 1 with the exception that bisphenol A propylene oxide (PO) and bisphenol A ethylene oxide (EO) as alcohol constituents, and alkenylsuccinic acid, terephthalic acid (TPA), and trimellitic acid as acid constituents were condensed in the molar ratio shown in Table 2 to obtain linear polyester resin (acid value: 32.3 mgKOH/g; hydroxyl (OH) value: 33.1 mgKOH/g; number-average molecular weight (Mn): 4400; weight-average molecular weight (Mw): 8400; Mw/Mn: 1.9; glass transition point: 56.9° C.; softening point: 95.1° C.; apparent melt viscosity at 90° C.: $4.0\times10^5$ poise) which was without constituents insoluble in tetrahydrofuran. Magenta toner 6 was used in a developer produced in the same manner as described for magenta toner 1 and evaluated. Color tone and transmittancy were invariably satisfactory. Fixing roller staining and soiling in the interior of the copying machine are practically satisfactry.

<Magenta Toner 7 Manufacture and Evaluation>

Figure 5:
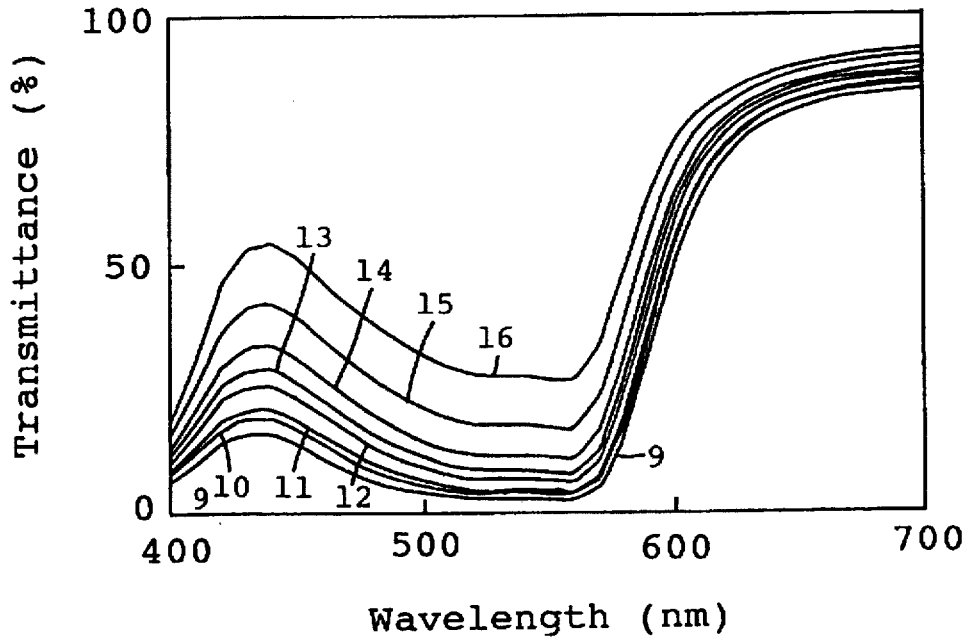

Magenta toner 7 was produced in the same manner as magenta toner 1 with the exception that 3 pbw of carmine 6B (C.I. Pigment Red 57-1; blow-off triboelectric charge: +4.2 μC/g) was used as a coloring agent. Magenta toner 7 was used in a developer produced in the same manner as described for magenta toner 1 and output images were made. Fixing roller staining characteristics, and copy machine operation characteristics were invariably satisfactory. However, when spectral reflectance was measured for a plurality of images formed with variable amounts of adhered toner, transmittance increased at 500~560 nm even when large amounts of toner were adhered, as shown in FIG. 5. Specifically, when transmittance at 540 nm is compared to that of magenta toner 1, it is found that magenta toner 7 has a transmittancy of about 28% at an adhered toner amount of 1.09 mg/cm$^2$ compared to magenta toner 1 which has a transmittancy of about 5% at an adhered toner amount of 1.15 mg/cm$^2$. This result indicates that the color of the image obtained by magenta toner 7 is one ideal magenta color mixed with the yellow constituent. In FIG. 5, reference numbers 9~16 refer to spectral reflectance curves when the amount of adhered toner is 0.20, 0.35, 0.50, 0.59, 0.71, 0.84, 0.97, and 1.09 mg/cm$^2$, respectively. When images were output on OHP transparencies to view transmission characteristics of the copy images projected by a overhead projector headlamp, shadows were observed, and sharp magenta color reproduction was not obtained.

<Magenta Toner 8 Manufacture and Evaluation>

Magenta toner 8 was produced in the same manner as magenta toner 1 with the exception that 3.0 pbw of anthraquinone magenta dye (TON Magenta 201: Mitsui Toatsu Dye, Inc.; blow-off triboelectric charge: −9.8 μC/g) was used as a coloring agent. When magenta toner 8 was used in a developer produced in the same manner as described for magenta toner 1 and output images were made, copy image color tone and transmittancy were excellent. However, after 5,000 copies were made, the fixing oil and fixing roller were visually examined, and magenta color adhesion was noted to the extent that conditions sufficient for continued use were not present.

<Magenta Toner 9 Manufacture and Evaluation>

Magenta toner 9 was produced in the same manner as magenta toner 1 with the exception that 3.0 pbw of rhodamine magenta dye (NEPTUNE RED BASE 486: BASF; blow-off triboelectric charge: +5.0 μC/g) was used as a coloring agent. When magenta toner 9 was used in a developer produced in the same manner as described for magenta toner 1 and output images were made, the carrier became spent during printing due to the toner, thereby causing toner airborne dispersion due to the reduction in carrier triboelectric charging capacity, and producing fogging in the copy image.

<Magenta Toner 10 Manufacture and Evaluation>

Magenta toner 10 was produced in the same manner as magenta toner 1 with the exception that bisphenol A propylene oxide (PO) and bisphenol A ethylene oxide (EO) as alcohol constituents, and fumaric acid (FA) and terephthalic acid (TPA) as acid constituents were condensed in the molar ratio (PO):(EO):(FA):(TPA)=5:5:5:4 to obtain linear polyester resin (acid value: 3.1 mgKOH/g; hydroxyl (OH) value: 32.0 mgKOH/g; number-average molecular weight (Mn): 6600; weight-average molecular weight (Mw): 15000; glass transition point: 59.0° C.; softening point: 95.2° C.; apparent melt viscosity at 90° C.: $4.0\times10^5$ poise) which was without constituents insoluble in tetrahydrofuran. To 100 pbw of the aforesaid polyester resin were added 3 pbw of anthraquinone dye (TON. Red. EX-59: Mitsui Toatsu Dye, Inc.), and 2.0 pbw of zinc complex of salicylic acid derivative (E-84: Orient Chemicals, Inc.) as a charge-controlling agent, and the materials were suitably mixed in a Henschel mixer, then kneaded in an extruder and cooled. The obtained mixture was coarsely pulverized in a feather mill, then finely pulverized in a jet pulverizer. The fine pulverization particles thus obtained were classified to obtain toner particles having a volumetric mean particle size of 8.0 μm.

To the aforesaid toner particles was added 0.5 pbw silica powder (H2000: Hoechst Co. Ltd.), and the materials were mixed in a Henschel mixer to obtained magenta toner <Magenta Toner 11 Manufacture and Evaluation>

Magenta toner 11 was produced in the same manner as magenta toner 10 with the exception that 2.25 pbw of anthraquinone dye (TON. Red. EX-59: Mitsui Toatsu Dye, Inc.) and 0.75 pbw quinacridone pigment (Hostaperm pink EB Toner grade VP2301: Hoechst Co. Ltd.) were added as coloring agents.

<Magenta Toner 12 Manufacture and Evaluation>

Magenta toner 12 was produced in the same manner as magenta toner 10 with the exception that 1.5 pbw of anthraquinone dye and 1.5 pbw quinacridone pigment were added as coloring agents.

<Magenta Toner 13 Manufacture and Evaluation>

Magenta toner 13 was produced in the same manner as magenta toner 10 with the exception that 0.75 pbw of anthraquinone dye and 2.25 pbw quinacridone pigment were added as coloring agents.

<Magenta Toner 14 Manufacture and Evaluation>

Magenta toner 14 was produced in the same manner as magenta toner 10 with the exception that only 3 pbw of quinacridone (HostapermPink EB Toner grade VP2301: Hoechst Co. Ltd.) was added as a magenta coloring agents.

<Magenta Toner 15 Manufacture and Evaluation>

Magenta toner 15 was produced in the same manner as magenta toner 10 with the exception that only 3 pbw of C.I. Pigment Red 57-1 (SEIKAFAST CARMINE 6B 1476T-7: Dainichi Seika Co., Ltd.) was added as a coloring agent.

<Evaluation of Magenta Toners 10~15>

(1) Evaluation of mixed color reproduction range

Yellow toner, cyan toner, and black toner having the mixed color reproduction range measurements of magenta toners 10~15 were produced in the same manner as magenta toner 1 with the exception that 3 pbw of C.I. Pigment Y-17 (KET Yellow 403: Dainippon Ink & Chemicals, Inc.), 3 pbw of C.I. Pigment Blue 15-3 (KET Blue 104: Dainippon Ink & Chemicals, Inc.), and 3 pbw of carbon black (MA-8: Mitsubishi Chemicals, Ltd.) were used as coloring agents in the respective toners.

A carrier identical to the carrier used in the evaluation of yellow toner 1 was mixed with each toner to obtain two-component developers having a toner density of 6 percent-by-weight.

Yellow toner and magenta toner mixed color images and magenta toner and cyan toner mixed color images were formed using each of the aforesaid developers in a full-color copy machine (model CF-80: Minolta Co., Ltd.) of the reversal development type provided with a negative charging organic photosensitive member and silicone oil application type fixing device with the amount of magenta toner, yellow toner, and cyan toner used for developing set at 0.7 mg/cm$^2$.

The color coordinates of the La*b* coordinate space of the obtained images were measured using a model CM-1000 color spectrometer (Minolta Co., Ltd.), and the chroma c* was calculated by the following equation.

$$C^* = \sqrt{(a^*)^2 + (b^*)^2}$$

Yellow toner mixed color characteristics (red chroma) were evaluated by the following symbols: excellent (c* of 70 or higher) was rated ⊙; good (c* of 65 or greater but less than 70) was rated ○; usable (c* of 60 or greater but less than 65) was rated Δ; and unusable (c* of less than 60) was rated X. The results are shown in Table 4.

Cyan toner mixed color characteristics (blue chroma) were evaluated by the following symbols: excellent (c* of 60 or higher) was rated ⊙; good (c* of 55 or greater but less than 60) was rated ○; usable (c* of 50 or greater but less than 55) was rated Δ; and unusable (c* of less than 50) was rated X. The results are shown in Table 4.

(2) Image fogging evaluation

Developers using each of the aforesaid magenta toners were used to form images in a full-color copy machine (model CF-80: Minolta Co., Ltd.), and the obtained images were visually evaluated for fogging. Images completely without fog were rated ⊙; very slight fog was rated ○; discernable fog was rated Δ; and extreme fog was rated X. The results are shown in Table 4.

(3) Light resistance evaluation

Developers using each of the aforesaid magenta toners were used to form images in a full-color copy machine (model CF-80: Minolta Co., Ltd.), and the obtained images were evaluated for light resistance using a fade meter after 6 hr forced exposure test. Images completely without color change were rated ⊙; very slight color matching was rated ○; and extreme color matching was rated X. The results are shown in Table 4.

(4) Sublimation (soiling apparatus interior) evaluation

Into a crucible was placed 0.2 g coloring agent used in each magenta toner, a CF paper was placed on the interior side of the crucible cover before closing, and the crucible was heated to 180° C. for 6 hr. Using a full-color copy machine (model CF-80: Minolta Co., Ltd.) 100, 000 copies were made, and the interior of the copy apparatus was visually examined for soiling. Copies completely without evidence of sublimation were rated ⊙; very slight red tinge on paper but insignificant soiling within the apparatus was rated ○; definite red tinge on paper with definite soiling within the apparatus was rated Δ; and extreme red staining of paper with severe soiling within the apparatus was rated X. The results are show clarity which presented some problem in background color were rated Δ; and copies having completely unsuitable background color were rated X. The results are shown in Table 4.

TABLE 4

| | Secondary color Reproduction range (a*,b*),c* | | | | | |
|---|---|---|---|---|---|---|
| | Red Chroma | Blue Chroma | Image Fogs | Light Resistance | Sublimation Resistance | Skin Tone Reproducibility |
| Magenta Toner 10 | (23,52),70.1 ⊙ | (23,-47),52.3 Δ | ⊙ | o | o | o |
| Magenta Toner 11 | (48,48),67.9 o | (28,-52),59.1 o | ⊙ | o | o | ⊙ |
| Magenta Toner 12 | (48,47),67.2 o | (28,-53),59.9 o | o | o | o | o |
| Magenta Toner 13 | (49,41),63.9 Δ | (28,-53),59.9 o | Δ | ⊙ | ⊙ | o |
| Magenta Toner 14 | (50,35),61.0 Δ | (29,-54),61.3 ⊙ | x | ⊙ | ⊙ | o |
| Magenta Toner 15 | (50,52),72.1 ⊙ | (34,-35),48.8 x | x | ⊙ | ⊙ | o |

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A yellow toner comprising:

(a) a linear polyester resin produced by condensation polymerization of an alcohol component comprising an aromatic diol expressed by the following general formula [I]:

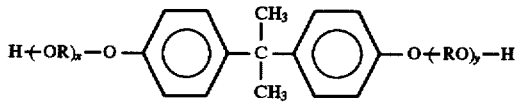

[I]

wherein R represents a ethylene radical or a propylene radical, x and y each represent an integer of 1 or more, and the average of x+y is in the range between 2 and 7, and an acid component; and (b) C. I. Solvent Yellow 162.

2. The toner as claimed in claim 1 wherein said acid component is a member selected from the group consisting of aliphatic dicarboxylic acids and aromatic dicarboxylic acids.

3. The toner as claimed in claim 1 wherein said polyester resin is produced by condensation polymerization of polyoxyethylene-bisphenol A, polyoxypropylene-bisphenol A, aromatic dicarboxylic acid and aliphatic dicarboxylic acid.

4. The toner as claimed in claim 1 wherein said polyester resin has an acid value of 1.0–35.0 mgKOH/g, a hydroxyl value of 10.0–40.0 mgKOH/g, a number-average molecular weight (Mn) of 3,000–10,000, a weight-average molecular weight (Mw) of 7,000–50,000, Mw/Mn of 1.0–5.0, a glass transition temperature (Tg) of 50°–70° C., a softening point (Tm) of 90°–110° C. and an apparent melt viscosity of $1\times10^5$–$5\times10^6$ poise.

5. The toner as claimed in claim 1, the amount of the C. I. Solvent Yellow 162 is in the range between 0.5 and 10 parts by weight on the basis of 100 parts by weight of the polyester resin.

6. A magenta toner comprising:

(a) a linear polyester resin produced by condensation polymerization of an alcohol component comprising an aromatic diol expressed by the following general formula [I]:

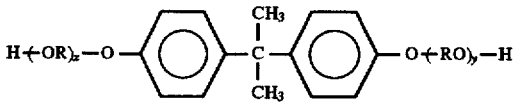

[I]

wherein R represents a ethylene radical or a propylene radical, x and y each represent an integer of 1 or more, and the average of x+y is in the range between 2 and 7, and an acid component; and (b) a compound expressed by the following general formula [II]:

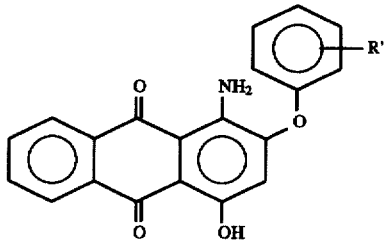

[II]

wherein R' represents a hydroxyalkyl group, an alkoxyalkyl group, an alkylaminosulfonyl group or an alkylcarboxyalkyl group.

7. The toner as claimed in claim 6 wherein said acid component is a member selected from the group consisting of aliphatic dicarboxylic acids and aromatic dicarboxylic acids.

8. The toner as claimed in claim 6 wherein said polyester resin is produced by condensation polymerization of polyoxyethylene-bisphenol A, polyoxypropylene-bisphenol A, aromatic dicarboxylic acid and aliphatic dicarboxylic acid.

9. The toner as claimed in claim 6 wherein said polyester resin has an acid value of 1.0–35.0 mgKOH/g, a hydroxyl value of 10.0–40.0 mgKOH/g, a number-average molecular weight (Mn) of 3,000–10,000, a weight-average molecular weight (Mw) of 7,000–50,000, Mw/Mn of 1.0–5.0, a glass transition temperature (Tg) of 50°–70° C., a softening point (Tm) of 90°–110° C. and an apparent melt viscosity of $1\times10^5$–$5\times10^6$ poise.

10. The toner as claimed in claim 6, the molecular weight of the compound is not less than 400.

11. The toner as claimed in claim 6, the amount of the compound is in the range between 0.5 and 10 parts by weight on the basis of 100 parts by weight of the polyester resin.

12. A magenta toner comprising:

(a) a linear polyester resin produced by condensation polymerization of an alcohol component comprising an aromatic diol expressed by the following general formula [I]:

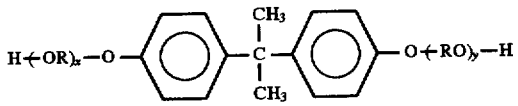

[I]

wherein R represents a ethylene radical or a propylene radical, x and y each represent an integer of 1 or more, and the average of x+y is in the range between 2 and 7, and an acid component; and (b) an anthraquinone magenta dye; and (c) a quinacridone magenta pigment.

13. The toner as claimed in claim 12 wherein said acid component is a member selected from the group consisting of aliphatic dicarboxylic acids and aromatic dicarboxylic acids.

14. The toner as claimed in claim 12 wherein said polyester resin is produced by condensation polymerization of polyoxyethylene-bisphenol A, polyoxypropylene-bisphenol A, aromatic dicarboxylic acid and aliphatic dicarboxylic acid.

15. The toner as claimed in claim 12 wherein said linear polyester resin has an acid value of 1.0–35.0 mgKOH/g, a hydroxyl value of 10.0–40.0 mgKOH/g, a number-average molecular weight (Mn) of 3,000–10,000, a weight-average molecular weight (Mw) of 7,000–50,000, Mw/Mn of 1.0–5.0, a glass transition temperature (Tg) of 50°–70° C., a softening point (Tm) of 90°–110° C. and an apparent melt viscosity of $1\times10^{5-5\times106}$ poise.

16. The toner as claimed in claim 12 wherein said anthraquinone dye is a compound expressed by the following general formula [II]:

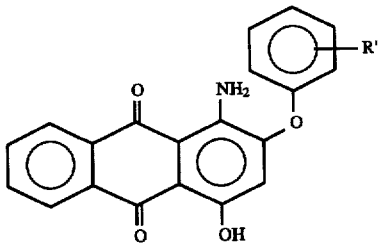

[II]

wherein R' represents a hydroxyalkyl group, an alkoxyalkyl group, an alkylaminosulfonyl group or an alkylcarboxyalkyl group.

17. The toner as claimed in claim 12 wherein said quinacridone pigment is C. I. Pigment Red 122.

18. The toner as claimed in claim 12, the total amount of the anthraquinone dye and the quinacridone pigment is in the range between 0.5 and 10 parts by weight on the basis of 100 parts by weight of the polyester resin.

19. The toner as claimed in claim 12, the weight ratio of the amount of the anthraquinone dye to the amount of the quinacridone pigment is 9:1–1:3.

20. An image forming method comprising steps of:

feeding a recording medium to an image forming station;

forming a resin-formed image on the recording medium in the image forming station using a toner, said toner comprising:

(a) a linear polyester resin produced by condensation-polymerization of an aromatic diol expressed by the following general formula [I]:

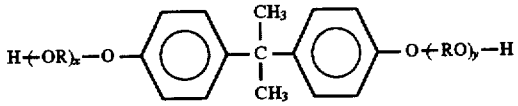

[I]

wherein R represents a ethylene radical or a propylene radical, x and y each represent an integer of 1 or more, and the average of x+y is in the range between 2 and 7, and an acid component; and (b) C. I. Solvent Yellow 162;

feeding the recording medium to a fusing station from the image forming station; and fusing the image in order to fix the image on the recording medium permanently.

21. The method as claimed in claim 20 wherein said acid component is a member selected from the group consisting of aliphatic dicarboxylic acids and aromatic dicarboxylic acids.

22. The method as claimed in claim 20 wherein the image forming is performed by electrophotography.

23. The method as claimed in claim 20 wherein the image forming step comprises:

forming a yellow image using the toner;

forming a magenta image and a cyan image; and overlaying the images each other in order to form a full-color image on a recording medium.

24. An image forming method comprising steps of:

feeding a recording medium to an image forming station;

forming a resin-formed image on the recording medium in the image forming station using a toner, said toner comprising:

(a) a linear polyester resin produced by condensation polymerization of an alcohol component comprising an aromatic diol expressed by the following general formula [I]:

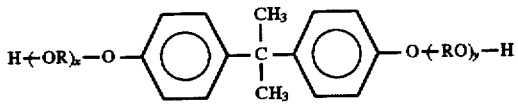

[I]

wherein R represents a ethylene radical or a propylene radical, x and y each represent an integer of 1 or more, and the average of x+y is in the range between 2 and 7, and an acid component; and (b) a compound expressed by the following general formula [II]:

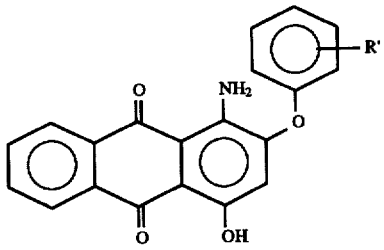

[II]

wherein R' represents a hydroxyalkyl group, an alkoxylalkyl group, an alkylaminosulfonyl group or an alkylcarboxylalkyl group;

feeding the recording medium to a fusing station from the image forming station; and fusing the image in order to fix the image on the recording medium permanently.

25. The method as claimed in claim 24 wherein said acid component is a member selected from the group consisting of aliphatic dicarboxylic acids and aromatic dicarboxylic acids.

26. The method as claimed in claim 24 wherein the image forming is performed by electrophotography.

27. The method as claimed in claim 24 wherein the image forming step comprises:

forming a magenta image using the toner;

forming a yellow image and a cyan image; and overlaying the images each other in order to form a full-color image on a recording medium.

28. An image forming method comprising steps of:

feeding a recording medium to an image forming station;

forming a resin-formed image on a recording medium using a toner, said toner comprising:

(a) a linear polyester resin condensation polymerization of an alcohol component comprising an aromatic diol expressed by the following general formula [I]:

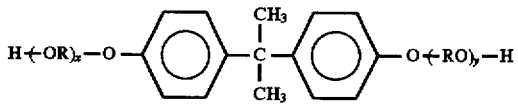

[I]

wherein R represents a ethylene radical or a propylene radical, x and y each represent an integer of 1 or more, and the average of x+y is in the range between 2 and 7, and an acid component;

(b) an anthraquinone magenta dye; and (c) a quinacridone pigment;

feeding the recording medium to a fusing station from the image forming station; and fusing the image in order to fix the image on the recording medium permanently.

29. The method as claimed in claim 28 wherein said acid component is a member selected from the group consisting of aliphatic dicarboxylic acids and aromatic dicarboxylic acids.

30. The method as claimed in claim 28 wherein the image forming is performed by electrophotography.

31. The method as claimed in claim 28 wherein the image forming step comprises:

forming a magenta image using the toner;

forming a yellow image and a cyan image; and overlaying the images each other in order to form a full-color image on a recording medium.

* * * * *